US005464028A

United States Patent [19]

Takeda et al.

[11] Patent Number: 5,464,028

[45] Date of Patent: Nov. 7, 1995

[54] CIGARETTE

[75] Inventors: Kazuko Takeda; Motohiko Muramatsu; Takashi Koyama, all of Yokohama, Japan

[73] Assignee: Japan Tobacco, Inc., Tokyo, Japan

[21] Appl. No.: 226,117

[22] Filed: Apr. 11, 1994

Related U.S. Application Data

[63] Continuation-in-part of Ser. No. 98,781, Jul. 29, 1993, abandoned.

[30] Foreign Application Priority Data

Jul. 29, 1992 [JP] Japan ..... 4-202202
Sep. 10, 1992 [JP] Japan ..... 4-242387

[51] Int. Cl.[6] ..... A24D 3/00

[52] U.S. Cl. ..... 131/336; 131/339

[58] Field of Search ..... 131/336, 339

[56] References Cited

U.S. PATENT DOCUMENTS

| | | | |
|---|---|---|---|
| 3,228,402 | 1/1966 | Lebert . | |
| 3,596,663 | 8/1971 | Shultz et al. . | |
| 4,256,122 | 3/1981 | Johnson | 131/338 X |
| 4,480,649 | 11/1984 | Hayes | 131/361 X |
| 4,488,563 | 12/1984 | Morifuji et al. . | |
| 4,553,556 | 11/1985 | Lephardt | 131/361 X |
| 4,582,071 | 4/1986 | Westcott et al. . | |
| 4,583,560 | 4/1986 | Sakai et al. | 131/338 X |
| 4,585,016 | 4/1986 | Grollimund | 131/361 |
| 4,637,409 | 1/1987 | Berger | 131/339 X |
| 4,699,158 | 10/1987 | Sprinkel | 131/336 |
| 4,724,848 | 2/1988 | Luke | 131/361 X |

FOREIGN PATENT DOCUMENTS

| | | | |
|---|---|---|---|
| 536107 | 4/1993 | European Pat. Off. . | |
| 2943561 | 3/1981 | Germany . | |
| 2090117 | 7/1982 | United Kingdom . | |
| 2133269 | 7/1984 | United Kingdom | 131/336 |

OTHER PUBLICATIONS

W. A. Selke, TR, Sep., 1978, pp. 40–43.

W. A. Selke et al, Beitrage zur Tabakforschung International, Band 9, Heft 4, Jul. 1978, pp. 193–197.

34th Tobacco Chemist' Research Conference, Recent Advances in Tobacco Science , vol. 6, Oct. 27–29, 1980, pp. 224–233.

38th Tobacco Chemist' Research Conference, Recent Advances in Tobacco Science, vol. 10, Nov. 5–8, 1984, pp. 52–63.

41st Tobacco Chemist' Research Conference, Recent Advances in Tobacco Science, vol. 13, Oct. 4–7, 1987, pp. 82–85.

US Application Serial No. 946,342, filed Nov. 9, 1992.

*Primary Examiner*—Jennifer Bahr

*Attorney, Agent, or Firm*—Birch, Stewart, Kolasch & Birch

[57] ABSTRACT

A vented filter cigarette with a filter having a fiber filter material and a plug wrap paper wrapping the fiber filter material, a tobacco rod, and tipping paper having a plurality of pores and connecting the filter and the tobacco rod. An embossment is formed in a region of the plug wrap paper corresponding to the pores of the tipping paper. The embossment creates a slight gap between the tipping paper and the circumference of the filter around the pores, with the result that the tightness between the tipping paper and the circumference of the filter is loosened, the filter ventilation is increased, and the variation in the filter ventilation is decreased.

11 Claims, 4 Drawing Sheets

CIGARETTE

This application is a continuation-in-part of application Ser. No. 08/098,781 filed on Jul. 29, 1993, now abandoned.

BACKGROUND OF THE INVENTION

1. Field of the Invention

The present invention relates to a cigarette and, more specifically, to an improvement in plug wrap paper used for a cigarette capable of reducing a variation in the amount of air flow from a filter (filter ventilation).

2. Description of the Related Art

A conventional cigarette filter is cylindrically formed of a fiber filter material such as cellulose diacetate wrapped by a plug wrap paper. A tipping paper is used to connect a filter rod and a tobacco rod. Vented filters each made by the combination of an air-permeable plug wrap paper and a tipping paper having pores formed by means of static electricity, a laser beam, etc. have recently been used widely to allow air to enter through the periphery of the filter and reduce the yield of smoke effusing through the filter rod. With the vented filter having the above-described structure, dilution air is inhaled into the smoker's mouth from the outer portion of the mouth end face of the filter, whereas tobacco smoke is inhaled into the mouth from the center portion of the mouth end face.

It has been confirmed that the conventional cigarette described above entails the problem of a large variation in filter ventilation even though the filter fiber, plug wrap paper, and tipping paper of the cigarette are made of the same material. Since the filter ventilation is greatly correlated with the amount of smoke inhaled, the variation in the filter ventilation is undesirable.

SUMMARY OF THE INVENTION

It is accordingly an object of the present invention to provide a cigarette capable of reliably controlling its filter ventilation.

To attain the above object, variation in filter ventilation of vented filter cigarettes was researched, and a variety of tests on the filter ventilation was carried out. The following results were obtained. The variation in filter ventilation is correlated with the variation in tightness between the plug wrap paper (or the circumference surface of a filter, in the case where no plug wrap paper is used) and tipping paper, rather than the variation in permeability of materials of the cigarettes. Depending on the degree of the tightness, the ventilation area of the permeable plug wrap paper through which dilution air passes varies from product to product, with the result that the filter ventilation cannot be controlled uniformly even though the same material is used.

In consideration of the above results, the inventors further carried out a number of tests and have discovered that the filter ventilation is increased and the variation therein is reduced by separating the pores of the tipping paper from the plug wrap paper of the filter by means of an embossment formed on the plug wrap paper and corresponding to the pores.

A vented filter cigarette according to the present invention comprises: a filter having a fiber filter material and a plug wrap paper wrapping the fiber filter material; a tobacco rod; and tipping paper having a plurality of pores and connecting the filter and the tobacco rod. An embossment is formed in a region of the plug wrap paper corresponding to the pores of the tipping paper.

With the above structure, the embossment creates a slight gap between the tipping paper and the plug wrap paper around the pores, with the result that the tightness between the tipping paper and the plug wrap paper is loosened, the filter ventilation is increased, and the variation in the filter ventilation is decreased.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
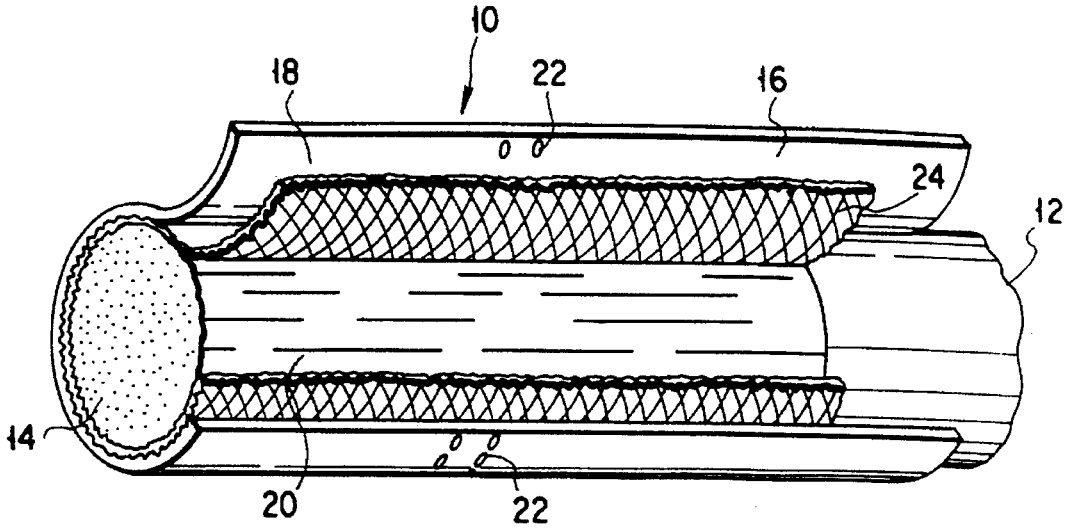
FIG. 1 is an exploded perspective view showing part of a cigarette according to a first embodiment of the present invention.

FIG. 1 shows part of a cigarette according to a first embodiment of the present invention. In FIG. 1, a cigarette 10 comprises a tobacco rod 12 and a filter 14. The filter 14 is made of a fiber filter material 20 such as cellulose diacetate wrapped by a plug wrap paper 18. Further, a tipping paper 16 is used to connect the filter 14 and the tobacco rod 12 with each other.

Since the cigarette 10 is of a vented filter type, it employs highly permeable plug wrap paper 18 having a Coresta permeability of 1000 or more in order to reduce the yield of smoke flowing out of the mouth end of the filter. Further, the tipping paper 16 has a number of ventilation pores 22 formed thereon in one or plural rows (two rows in this embodiment) or irregularly along the circumferential direction of the cigarette. The pores 22 of the tipping paper 16 can be formed by a known technique using static electricity, a laser beam, etc. With the cigarette 10 of this type, dilution air is inhaled into the smoker's mouth from the outer portion of the mouth end face of the filter, and tobacco smoke from the center portion thereof.

A rhombic grid-patterned embossment 24 is formed on the entire surface of the plug wrap paper 18. Since the embossment 24 is printed by means of, for example, a knurling tool, it provides ruggedness all over the plug wrap paper 18.

An explanation will be given in relation to the vented filter cigarettes to which the present invention is applied.

A vented filter cigarette was developed in the 1970s. Since then, a number of the different designs of the vented filter cigarettes and the analysis of their ventilation mechanism have been reported. The vented filter cigarettes are characterized by a plurality of pores formed on a tipping paper which connects a filter and a tobacco rod. The basic structure of the vented filter cigarettes is shown in publications such as five reports listed below, the teaching of which are hereby incorporated by reference.

(1) Permeable papers for cigarette construction by W. A. Welke, 1978; Tobacco Reporter, September; 40–43.

(2) The Permeability of Cigarette Papers and Cigarette Ventilation by W. A. Selke, 1978; Beitrage zur Tabakforshung International, 9; 193–200.

(3) Physical Parameters That Affect Composition of Smoke by M. L. Delucia, C. F. Mattina and W. A. Selke, 1980; Paper presented at 34th Tobacco Chemists' Research Conference, Richmond, Va.; 225–238.

(4) The Choice of Paper Components for Low Tar Cigarettes by D. F. Durocher, 1984; Paper presented at 38th Tobacco Chemists' Research Conference, Atlanta, Ga.; 52–71.

(5) Sources of Pressure-drop and Ventilation Variability in Cigarettes by R. W, Dwyer, K. A. Cox and J. A. Bickett, 1987; Paper presented at 41st Tobacco Chemists' Research Conference, Greensboro, N.C.; 82–118.

The cigarettes of this type employ a highly permeable paper as the plug wrap paper of a filter in order to allow air introduced from the pores of a tipping paper to pass through the plug wrap paper. The plug wrap paper and the tipping paper are adhered by glue except for a region around the pores of the tipping paper to leave a ventilation area of the plug wrap paper through which air passes. The tobacco rod and the tipping paper are also adhered by glue, thereby connecting the filter to the tobacco rod by the tipping paper.

In other words, the glue is applied inside the tipping paper entirely except for the region having a predetermined width which covers the pores. In this region of predetermined width, a passageway or space for a dilution air is produced, communicating with the pores of the tipping paper and the ventilation area of the plug wrap paper.

Figure 11:
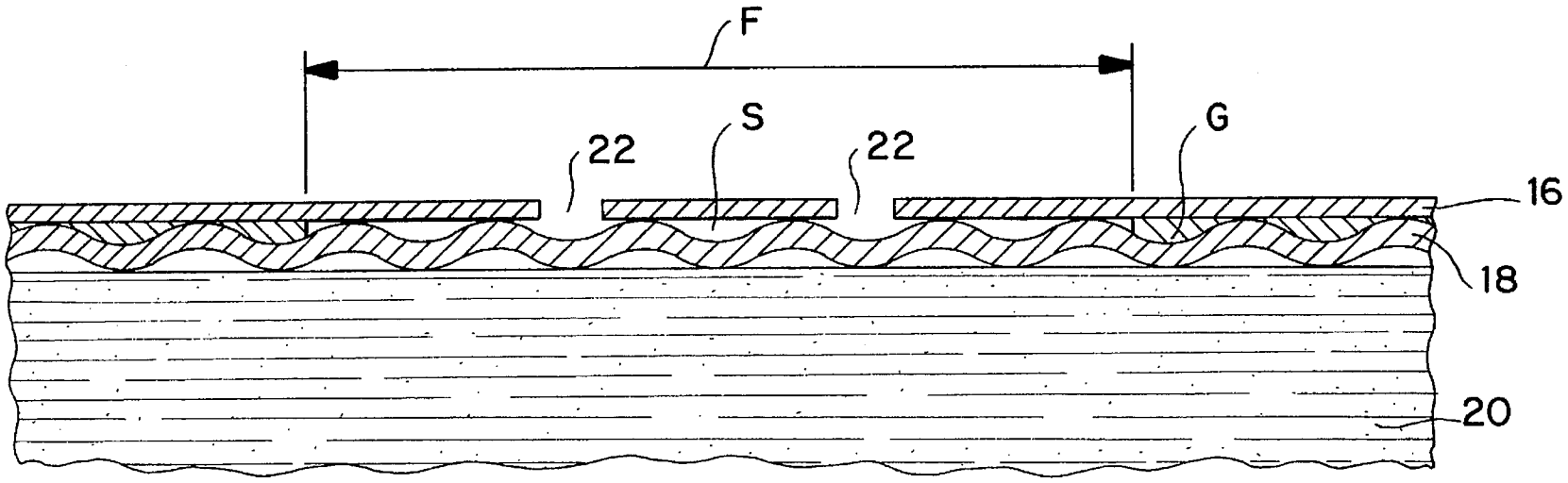
FIG. 11 is a sectional view showing a structure around the pores of the cigarette shown in FIG. 1 when the cigarette is sectioned axially.

FIG. 11 is a sectional view showing a structure around the pores 22 of the cigarette 10 shown in FIG. 1 according to the present invention when the cigarette 10 is sectioned axially. As shown in FIG. 11, the cigarette 10 of the vented filter type is supplied with glue G on all the backside of the tipping paper 16 except for an annular region F having a predetermined width which corresponds to or covers the pores 22. The ventilation area of the plug wrap paper 18 is formed in the annular region F.

The ventilation area is an area of the plug wrap paper 18 through which a dilution air from the pores 22 passes and thus to which the dilution air reaches. Therefore, the width of the ventilation area varies, depending on not only the width of the annular region F but also the depth of the pattern of the embossment 24. The ventilation area becomes wider as the embossment 24 grows deeper.

Although the embossment 24 is formed on the entire surface of the plug wrap paper 18, part of the embossment 24 outside the ventilation area does not contribute to the production of a passageway or space S connecting the ventilation area to the pores 22 for the dilution air. Especially, outside the annular region F, all the recesses formed by the embossment 24 between the tipping paper 16 and the plug wrap paper 18 are filled with the glue G so that the space S does not directly communicate through any gap between the tipping paper 16 and the plug wrap paper 18 with either of the mouth end face of the filter 14 or the other end of the tipping paper 16 on the tobacco rod side.

In this embodiment, the annular region F free of the glue G is set to have a width W of 3 to 6 mm on either side of the pores 22. However, the glue G may be applied on the backside of the tipping paper 16 regardless of this range such that the filter 14 and the tobacco rod 12 are firmly connected, and the space S does not directly communicate with either end of the tipping paper 16. The manner of applying the glue G is common to the embodiments of the present invention described hereinafter. As the glue G, a conventional glue, such as polyvinyl acetate, may be used.

The tightness between the tipping paper 16 and the plug wrap paper 18 is loosened and fixed by the embossment 24, so that the passageway or space S for the dilution air is set to have a constant thickness, thereby fixing the degree of the expansion of the dilution air. In other words, it is possible by using the embossment 24 to define a ratio in the surface area of the plug wrap paper 18 exposed to the dilution air per pore 22 of the tipping paper 16, and to decrease the variation in the filter ventilation among cigarettes. The vented filter cigarettes are now required to have an accurately controlled degree of the filter ventilation. The vented filter cigarette according to the present invention can satisfy this demand.

In contrast, the conventional vented filter cigarettes have a disadvantage that the thickness of the passageway or space connecting the pores of a tipping paper and the ventilation area of a plug wrap paper varies with wrapping forces in cigarette making, thereby a variation in the filter ventilation being caused.

In the cigarette having the foregoing structure according to the present invention, the embossment 24 serves to create a slight gap between the tipping paper 16 and the plug wrap paper 18 around the pores 22, with the result that the tightness between the papers 16 and 18 is loosened, and the permeability of a combination of the pores 22 and the plug wrap paper 18 is improved. In addition, the embossment 24 reduces the variation in the air permeability of the combination of the papers 16 and 18. Consequently, the filter ventilation is increased, and the variation in the filter ventilation is decreased.

In this embodiment, the depth of the pattern of the embossment 24 is set to be 0.08 to 0.1 mm, which is most preferable. However, the depth may be set to be 0.01 to 1.00 mm, preferably 0.02 mm or more. If the depth exceeds the range, a problem in cigarette making can occur, whereas if the depth does not reach the range, the effect of the embossment 24 cannot be obtained sufficiently. In an aspect for filling the recess of the embossment 24 with the glue G, it is preferable to set the depth to be 0.25 mm or less. The depth of the embossment 24 can be measured by using a three-dimensional surface roughness measuring instrument (SE-3AK manufactured by Kosaka Laboratory Ltd.).

It is also desirable that the embossment 24 should be disposed such that the surface thereof, which is brought into contact with the pattern press die, faces the tipping paper 16. If the contact surface of the embossment faces the tipping paper 16, the pores 22 of the tipping paper 16 can be separated sufficiently from the plug wrap paper 18 of the filter 14. In the contrary case, the effect of the embossment is slightly lessened as compared to the former case.

Figure 2:
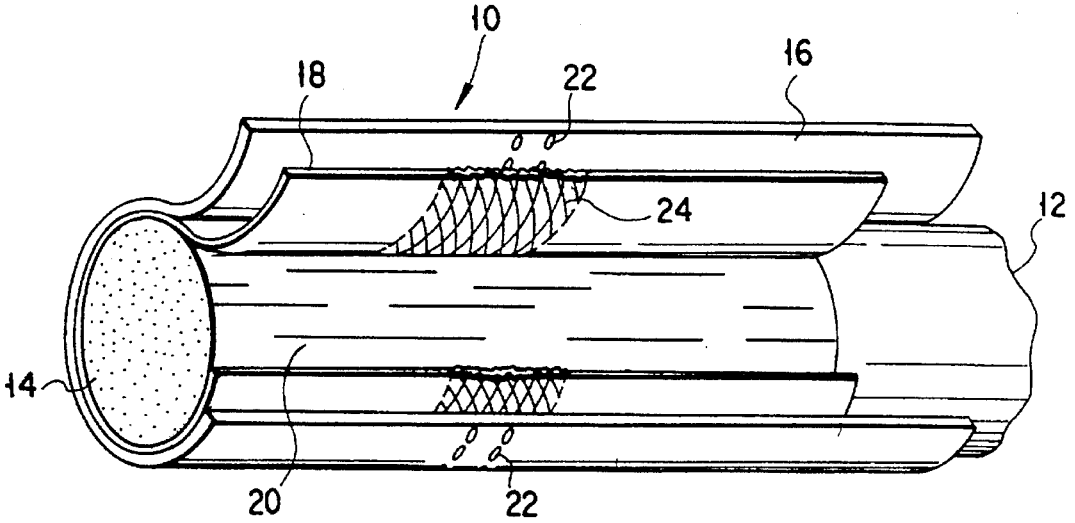
FIG. 2 is an exploded perspective view showing part of a cigarette according to a second embodiment of the present invention.

FIG. 2 shows part of a cigarette according to a second embodiment of the present invention. In FIG. 2, the elements corresponding to those of the first embodiment shown in FIG. 1 are denoted by the same numerals as those in FIG. 1, and the description thereof is omitted.

In the second embodiment, the embossment 24 of the plug wrap paper 18 is disposed so as to be located along the rows of the pores 22 of the tipping paper 16. The embossment 24 is printed in a band-like region such that the pores 22 of the tipping paper 16 are arranged substantially along the imaginary center line of the region, by means of, for example, a knurling tool. Thus, the embossment 24 provides ruggedness in the entire area of the band-like region around the pores 22 of the tipping paper 16.

Figure 3:
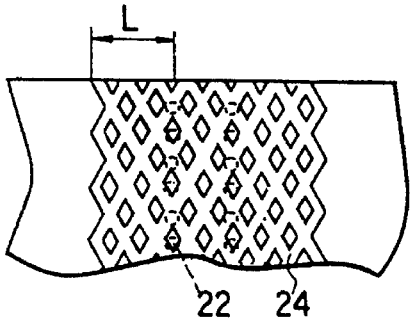
FIG. 3 is an enlarged schematic view showing the pattern of an embossment formed on the plug wrap paper of the cigarettes shown in FIGS. 1 and 2.

If the embossment 24 is formed on only part of the plug wrap paper 18 as in the second embodiment, it is desirable that the edge of the embossment 24 should be at least 1 mm apart from either side of the pore rows, that is, L shown in FIG. 3 should be 1 mm or more, preferably L should be 2 mm or more. If the width is less than 1 mm, it is difficult to create a gap sufficiently between the pores 22 and the plug wrap paper 18.

Figure 4:
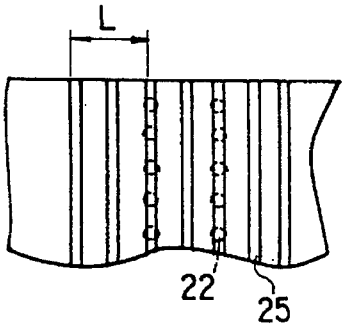
FIG. 4 is an enlarged schematic view showing the pattern of another embossment formed on the plug wrap paper.
Figure 5:
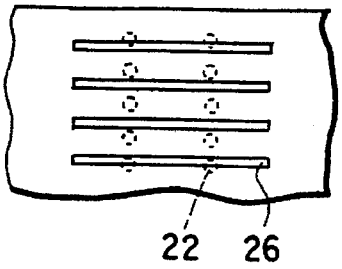
FIG. 5 is an enlarged schematic view showing the pattern of still another embossment formed on the plug wrap paper.
Figure 6:
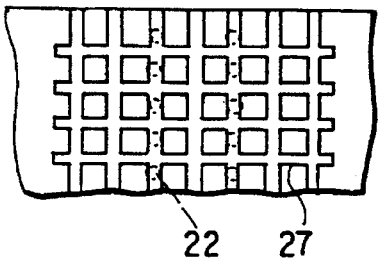
FIG. 6 is an enlarged schematic view showing the pattern of still another embossment formed the plug wrap paper.

The pattern of the embossment 24 is not limited to the rhombic grid-patterned grooves shown in FIGS. 1 and 2, which is enlargedly shown in FIG. 3, but can be replaced with various patterns. Some of the basic examples are shown in FIGS. 4 to 6. FIG. 4 shows an embossment 25 having a pattern of grooves arranged parallel to the rows of the pores 22, FIG. 5 shows an embossment 26 having a pattern of grooves arranged perpendicular to the rows of the pores 22, and FIG. 6 shows an embossment 27 having a pattern of a square grid.

Figure 7:
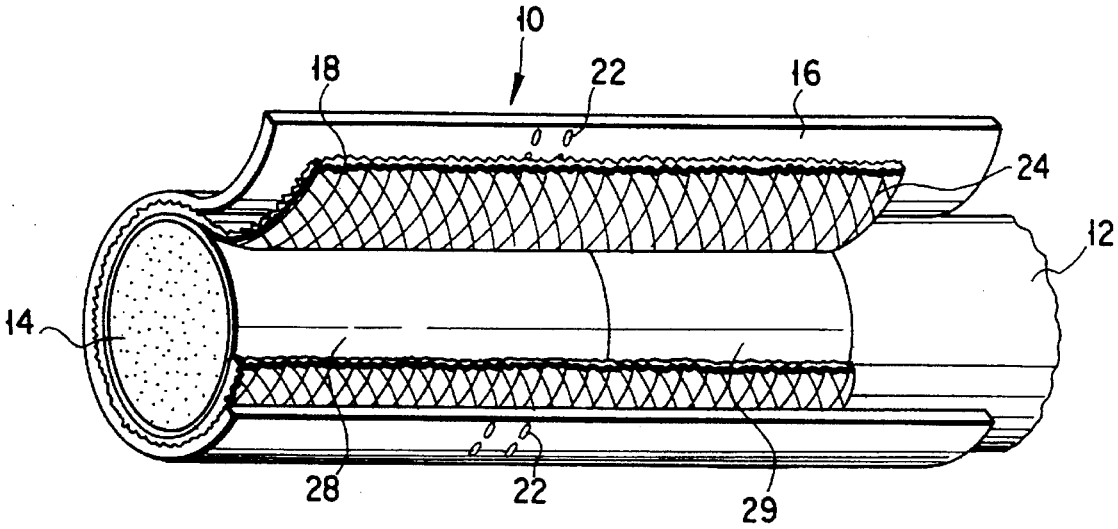
FIG. 7 is an exploded perspective view showing part of a cigarette according to a third embodiment of the present invention.
Figure 8:
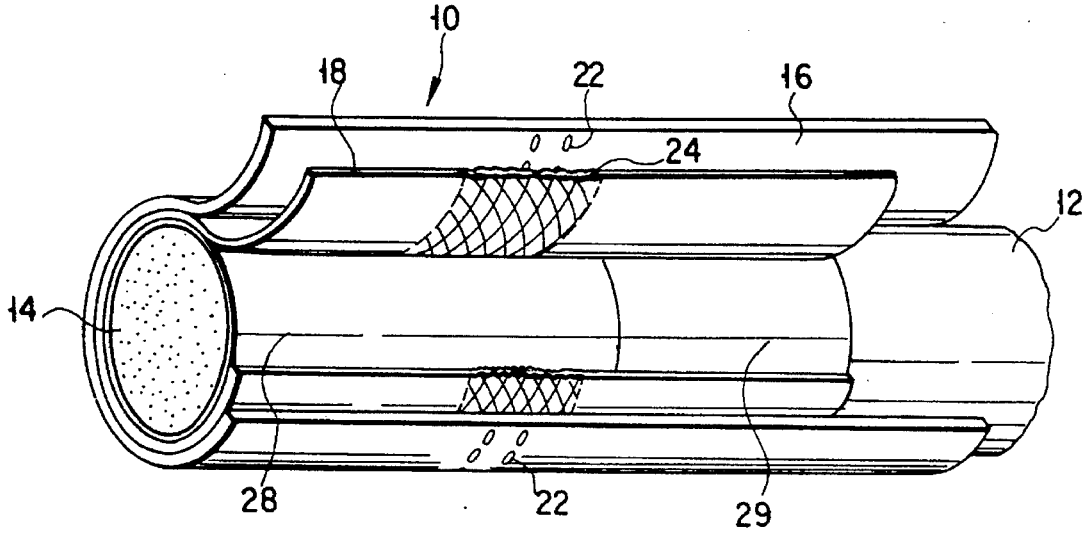
FIG. 8 is an exploded perspective view showing part of a cigarette according to a fourth embodiment of the present invention.

FIGS. 7 and 8 show part of cigarettes according to third and fourth embodiments of the present invention, respectively. In FIGS. 7 and 8, the elements corresponding to those of the first and second embodiments shown in FIGS. 1 and 2 are denoted by the same numerals as those in FIGS. 1 and 2, and the description thereof is omitted.

In the third embodiment shown in FIG. 7, the embossment 24 is formed all over the plug wrap paper 18 as in the first embodiment. In the fourth embodiment shown in FIG. 8, the embossment 24 is formed on part of the plug wrap paper 18 as in the second embodiment.

In the third and fourth embodiments, the filter 14 has a so-called dual-filter structure including a first filter element 28 having a length of, e.g., 15 mm and a second filter element 29 having a length of, e.g., 10 mm. The first filter element 28 is generally called an acetate filter which is formed of a fiber filter material such as cellulose diacetate wrapped by its own plug wrap paper and serves as a filter plug. In other words, the first filter element 28 is arranged inside the plug wrap paper 18. The second filter element 29 is generally called a charcoal filter which is formed of a fiber filter material such as cellulose diacetate containing charcoal wrapped by its own plug wrap paper and serves as a filter plug. In other words, the second filter element 29 is also arranged inside the plug wrap paper 18.

The first and second filter elements 28 and 29 are integrated with each other as one element by the embossed plug wrap paper 18. The plug wrap paper 18 is therefore called "forming paper". The terminologies "filter" and "embossed plug wrap paper" used in this specification include the above-described dual-structure filter, the undermentioned triple-structure filter, and the plug wrap paper (forming paper) used in these filters.

Figure 9:
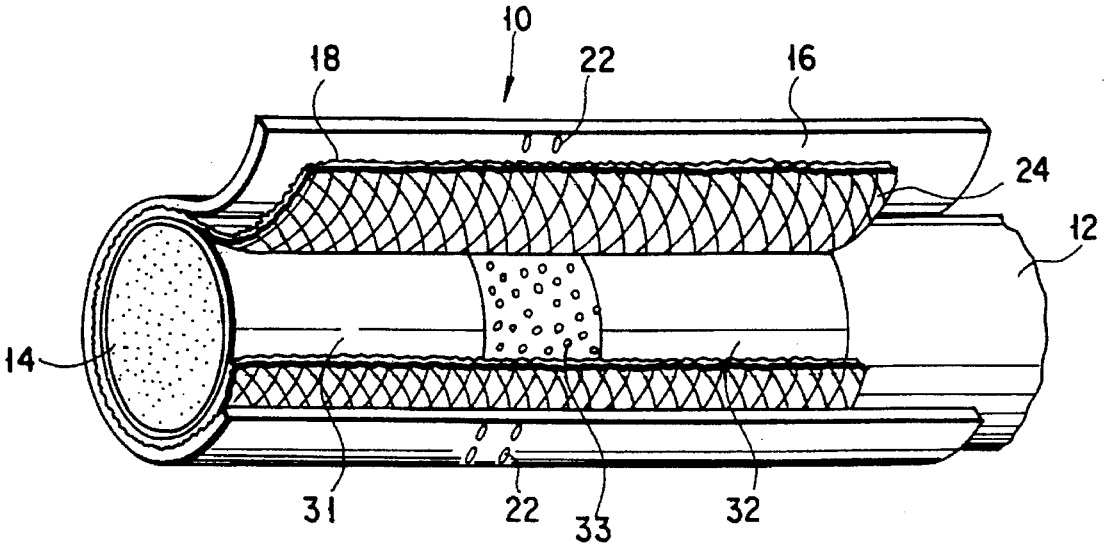
FIG. 9 is an exploded perspective view showing part of a cigarette according to a fifth embodiment of the present invention.
Figure 10:
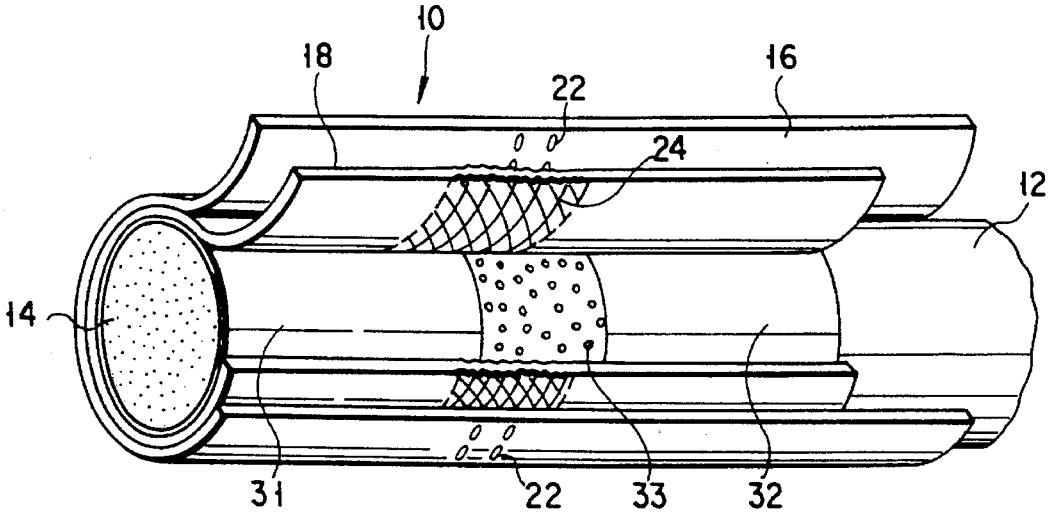
FIG. 10 is an exploded perspective view showing part of a cigarette according to a sixth embodiment of the present invention.

FIGS. 9 and 10 show part of cigarettes according to fifth and sixth embodiments of the present invention, respectively. In FIGS. 9 and 10, the elements corresponding to those of the first and second embodiments shown in FIGS. 1 and 2 are denoted by the same numerals as those in FIGS. 1 and 2, and the description thereof is omitted.

In the fifth embodiment shown in FIG. 9, the embossment 24 is formed all over the plug wrap paper 18 as in the first embodiment. In the sixth embodiment shown in FIG. 10, the embossment 24 is formed on part of the plug wrap paper 18 as in the second embodiment.

In the fifth and sixth embodiments, the filter 14 has a so-called triple-filter structure including first and second filter elements 31 and 32, and an intermediate section 33 formed between them. The first and second filter elements 31 and 32 are generally called an acetate filter which is formed of a fiber filter material such as cellulose diacetate wrapped by its own plug wrap paper and serves as a filter plug. In other words, the first and second filter elements 31 and 32 are arranged inside the plug wrap paper 18. The intermediate section 33 is formed by filling a gas absorbent such as activated carbon between the filter elements 31 and 32 separated from each other. The first and second filter elements 31 and 32 and the intermediate section 33 are integrated with one another as one element by the embossed plug wrap paper 18.

In the first to sixth embodiments described above, the tipping paper 16 has two rows of pores 22. However, the present invention is not limited to this tipping paper but can be applied to tipping paper having a larger number of pores, such as porous tipping paper. Where an embossment is formed on the plug wrap paper in correspondence with some of the pores of the porous tipping paper, the same advantage can be obtained.

The following experiments were conducted by using cigarettes according to above embodiments.

EXPERIMENT 1

A cigarette sample B according to the first embodiment shown in FIG. 1 was prepared by using the plug wrap paper 18 on which the embossment 24 (shown in FIG. 3) having the rhombic grid-pattern was formed, and the other regular members. For the sake of comparison, a cigarette sample A having no embossment, but otherwise substantially the same as the sample B was also prepared. The conditions other than the embossment, for example, the material and the production method were common to the samples A and B under the conditions specified in Table 1. Each cigarette had a length of 84 mm, a filter length 25 mm, a circumference of 25 mm, and a draw resistance of the tobacco rod of 80 mm $H_2O$.

100 samples were prepared for each of the samples A and B, and the filter ventilation of these samples was measured with a ventilation meter. The results are shown in Table 1. In this Table, the air permeability of the tipping paper and plug wrap paper is indicated by the Coresta unit. Further, reference symbol X is an average of the degree of filter ventilation, reference symbol σ is a standard deviation thereof, and reference CV is a variation coefficient expressed by the following equation.

$$Cv=(\sigma/X)\times 100(\%)$$

TABLE 1

| | | Material/Permeability (Coresta) | | | | | |
|---|---|---|---|---|---|---|---|
| Tipping Paper | | 600 | 600 | 600 | 1200 | 1200 | 1200 |
| Plug Wrap Paper (Forming Paper) | | 2000 | 4000 | 10000 | 2000 | 4000 | 10000 |
| Sample/Filter Ventilation | | | | | | | |
| A | X | 29.2 | 32.1 | 33.6 | 34.5 | 38.7 | 44.5 |
| | σ | 2.36 | 3.52 | 3.56 | 2.30 | 3.60 | 3.66 |
| | CV | 8.08 | 10.97 | 10.59 | 6.66 | 9.30 | 8.22 |
| B | X | 31.4 | 38.8 | 42.8 | 37.3 | 47.8 | 53.1 |
| | σ | 1.98 | 2.37 | 2.58 | 2.18 | 3.01 | 2.63 |
| | CV | 6.30 | 6.11 | 6.02 | 5.83 | 6.29 | 4.95 |

As can be seen in Table 1, it was confirmed that the sample B exhibited an increased filter ventilation and a reduced variation therein, as compared with the sample A having no embossment formed.

EXPERIMENT 2

A cigarette sample D having a dual-filter structure according to the third embodiment shown in FIG. 7 was prepared by using the plug wrap paper 18 on which the embossment 24 (shown in FIG. 3) having the rhombic grid-pattern is formed, and the other regular members. For the sake of comparison, a cigarette sample C having no embossment, but otherwise substantially the same as the sample D was also prepared. The conditions other than the embossment, for example, the material and the production method were common to the samples C and D under the conditions specified in Table 2. Each cigarette had a length of 84 mm, a first filter element length of 15 mm, a second filter element length of 10 mm, a circumference of 25 mm, and a draw resistance of the tobacco rod of 80 mm $H_2O$.

100 samples were prepared for each of the samples C and D, and the filter ventilation of these samples was measured with a ventilation meter. The results are shown in Table 2. In this Table, the air permeability of the tipping paper and plug wrap paper is indicated by the Coresta unit. Further, reference symbol X is an average of the degree of filter ventilation, reference symbol σ is a standard deviation thereof, and reference CV is a variation coefficient expressed by the following equation.

$$Cv=(\sigma/X)\times 100\ (\%)$$

TABLE 2

| | | Material/Permeability (Coresta) | |
|---|---|---|---|
| Tipping Paper | | 600 | 1200 |
| Plug Wrap Paper (Forming Paper) | | 4000 | 4000 |
| Sample/Filter Ventilation | | | |
| C | X | 33.5 | 38.4 |
| | σ | 5.12 | 5.56 |
| | CV | 15.28 | 14.47 |
| D | X | 45.2 | 50.0 |
| | σ | 3.08 | 3.72 |
| | CV | 6.81 | 7.44 |

As can be seen in Table 2, it was confirmed that the sample D exhibited an increased filter ventilation and a reduced variation therein, as compared with the sample C having no embossment formed.

Additional advantages and modifications will readily occur to those skilled in the art. Therefore, the invention in its broader aspects is not limited to the specific details, and representative devices, shown and described herein. Accordingly, various modifications may be made without operating from the spirit or scope of the general inventive concept as defined by the appended claims and their equivalents.

What is claimed is:

1. A vented filter cigarette comprising:

a filter having a fiber filter material and a permeable plug wrap paper wrapping the fiber filter material, the plug wrap paper having a Coresta permeability of 1000 or more;

a tobacco rod; and tipping paper having a plurality of pores and connecting the filter and the tobacco rod;

wherein the permeable plug wrap paper having a ventilation area which faces the pores and through which dilution air from the pores passes, and wherein an embossment having grooves of a grid-pattern is formed on the plug wrap paper at least in the ventilation area and not to reach either end of the plug wrap paper, in order to loosen tightness between the tipping paper and the plug wrap paper in the ventilation area to control filter ventilation of the cigarette and to reduce variation in the filter ventilation.

2. The cigarette according to claim 1, wherein said embossment is formed in a region having a width of 1 mm or more on either side of the pores.

3. The cigarette according to claim 2, wherein said embossment is formed in a region having a width of 2 mm or more on either side of the pores.

4. The cigarette according to claim 1, wherein said embossment has a depth ranging from 0.01 to 1.0 mm.

5. A vented filter cigarette comprising:

a filter having a fiber filter material and a permeable plug wrap paper wrapping the fiber filter material, the plug wrap paper having a Corseta permeability of 1000 or more;

a tobacco rod;

tipping paper having a plurality of pores and connecting the filter and the tobacco rod; and glue adhering the tipping paper to the plug wrap paper and to the tobacco rod, the glue being arranged between the plug wrap paper and the tipping paper to leave an annular region free of the glue so that the permeable plug wrap paper has a ventilation area which faces the pores and through which dilution air from the pores passes, and the annular region does not directly communicate through any gap between the tipping paper and the plug wrap paper with either end of the plug wrap paper;

wherein an embossment having grooves of a grid-pattern is formed on the plug wrap paper at least in the ventilation area in order to loosen and fix tightness between the tipping paper and the plug wrap paper in the ventilation area to control filter ventilation of the cigarette and to reduce variation in the filter ventilation.

6. The cigarette according to claim 5, wherein said embossment is formed on the plug wrap paper to extend out of the annular region, and a gap formed by the embossment between the plug wrap paper and the tipping paper outside the annular region is filled with the glue.

7. The cigarette according to claim 6, wherein said annular region is formed to have a width of 2 to 6 mm on either side of the pores.

8. The cigarette according to claim 5, wherein said embossment is formed in a region having a width of 1 mm or more on either side of the pores.

9. The cigarette according to claim 8, wherein said embossment is formed in a region having a width of 2 mm or more on either side of the pores.

10. The cigarette according to claim 9, wherein said embossment is formed almost all over the plug wrap paper.

11. The cigarette according to claim 5, wherein said embossment has a depth ranging from 0.01 to 0.25 mm.

* * * * *